US009615158B2

(12) United States Patent
Silvestri et al.

(10) Patent No.: US 9,615,158 B2
(45) Date of Patent: Apr. 4, 2017

(54) EARPIECE

(71) Applicant: Bose Corporation, Framingham, MA (US)

(72) Inventors: Ryan Silvestri, Franklin, MA (US); Michael J. Monahan, Southborough, MA (US)

(73) Assignee: Bose Corporation, Framingham, MA (US)

( * ) Notice: Subject to any disclaimer, the term of this patent is extended or adjusted under 35 U.S.C. 154(b) by 3 days.

(21) Appl. No.: 14/641,391

(22) Filed: Mar. 8, 2015

(65) Prior Publication Data

US 2016/0261944 A1 Sep. 8, 2016

(51) Int. Cl.
*H04R 1/10* (2006.01)
*H04R 1/28* (2006.01)

(52) U.S. Cl.
CPC ..... *H04R 1/1016* (2013.01); *H04R 1/2826* (2013.01); *H04R 2460/11* (2013.01)

(58) Field of Classification Search
CPC . H04R 1/1016; H04R 2460/11; H04R 25/652
See application file for complete search history.

(56) References Cited

U.S. PATENT DOCUMENTS

| | | | |
|---|---|---|---|
| 5,887,070 | A | 3/1999 | Iseberg et al. |
| 7,916,888 | B2 | 3/2011 | Sapiejewski et al. |
| 8,254,621 | B2 | 8/2012 | Silvestri et al. |
| 8,594,351 | B2 | 11/2013 | Harlow et al. |
| 8,670,586 | B1 | 3/2014 | Boyle et al. |
| 8,682,001 | B2 | 3/2014 | Annunziato |
| 8,737,669 | B2 | 5/2014 | Monahan et al. |
| 8,755,550 | B2 | 6/2014 | Monahan et al. |
| 2008/0123890 | A1 | 5/2008 | Peng |
| 2009/0238388 | A1 | 9/2009 | Saltykov et al. |
| 2009/0316944 | A1 | 12/2009 | Tiscareno et al. |
| 2011/0058704 | A1 | 3/2011 | Harlow et al. |
| 2011/0311070 | A1 | 12/2011 | Epping |
| 2013/0058493 | A1 | 3/2013 | Darlington et al. |
| 2013/0315410 | A1 | 11/2013 | Annunziato et al. |
| 2013/0343593 | A1 | 12/2013 | Howes et al. |

FOREIGN PATENT DOCUMENTS

| | | | |
|---|---|---|---|
| EP | 0688143 | A2 | 12/1995 |
| WO | 2009140982 | A1 | 11/2009 |
| WO | 2013192340 | A1 | 12/2013 |

OTHER PUBLICATIONS

International Search Report and Written Opinion dated May 24, 2016 for International application No. PCT/US2016/021173.

*Primary Examiner* — Matthew Eason

(57) ABSTRACT

An earpiece includes a body having an acoustic driver and an output aperture. A sealing structure extends from a region adjacent the output aperture to hold the output aperture adjacent to the entrance of a user's ear canal. An acoustic nozzle having an acoustic passage conducts sound waves from the acoustic driver to the output aperture. The acoustic passage has a proximal end adjacent the acoustic driver and a distal end adjacent the output aperture. First acoustic impedance is provided at the proximal end of the acoustic nozzle adjacent the acoustic driver. Second acoustic impedance is provided at the distal end of the acoustic nozzle adjacent the output aperture. The volume of the acoustic nozzle and the first and second acoustic impedances are selected to control resonance in the user's ear canal when the sealing structure is engaged with the entrance to the user's ear canal.

22 Claims, 7 Drawing Sheets

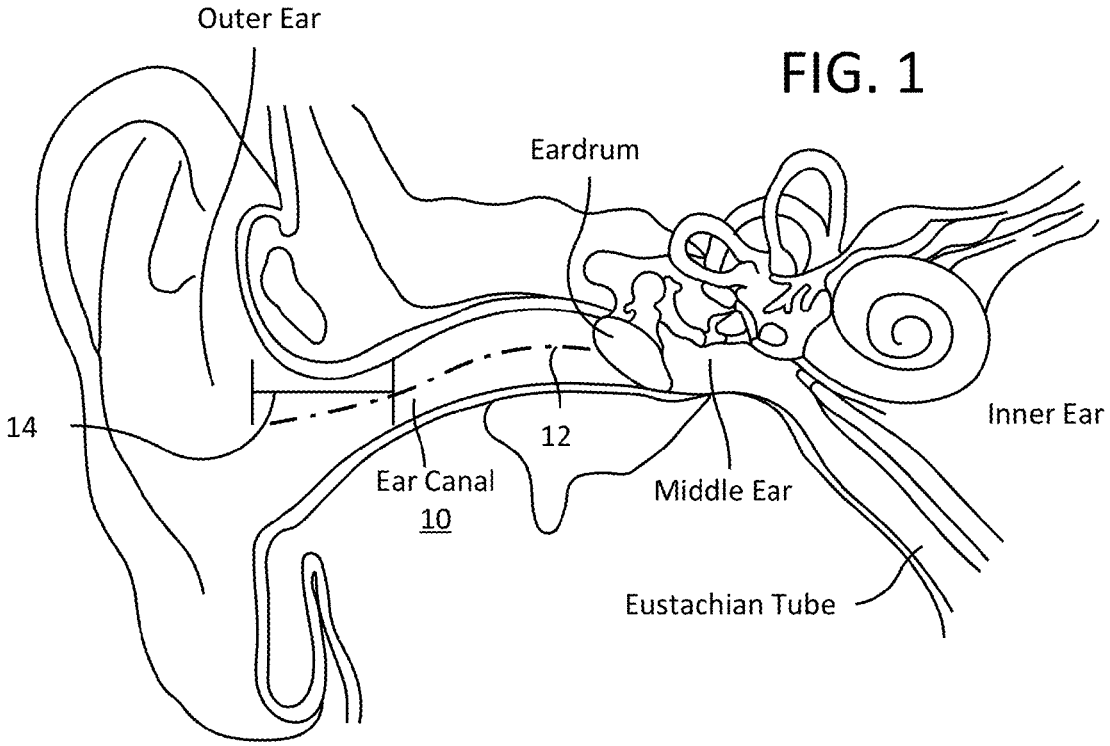
FIG. 1
FIG. 2
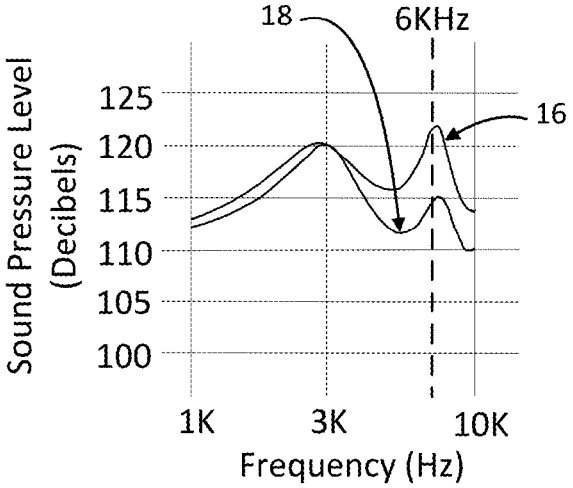

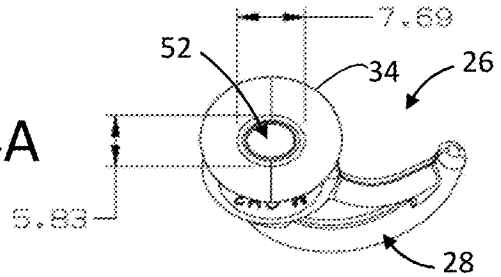
Fig. 4A
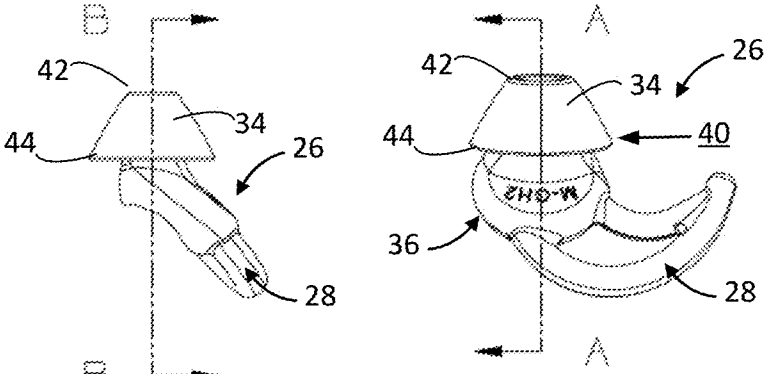
Fig. 4B
Fig. 4C
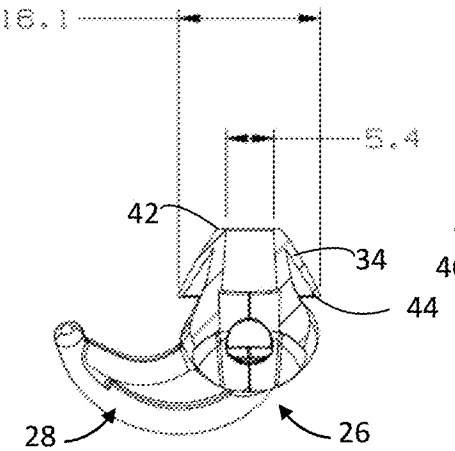
SECTION B - B
Fig. 5A
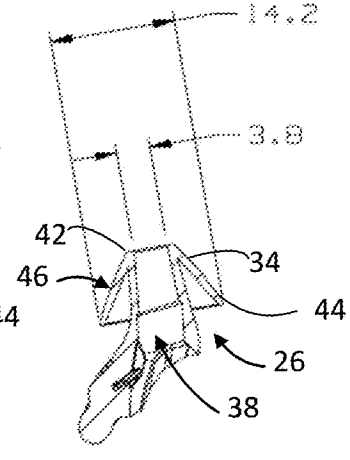
SECTION A - A
Fig. 5B

EARPIECE

BACKGROUND

This disclosure relates to audio systems and related devices and methods, and, particularly, to an earpiece having an acoustic nozzle configured to reduce resonance within a user's ear canal.

SUMMARY

All examples and features mentioned below can be combined in any technically possible way.

In one aspect, an earpiece includes an acoustic driver and an acoustic nozzle extending from the acoustic driver toward an output aperture, the acoustic nozzle including an acoustic passage between an entrance aperture and the output aperture to conduct sound waves from the acoustic driver toward the output aperture, the acoustic passage having a proximal end adjacent the acoustic driver and a distal end toward the output aperture. The earpiece also includes a sealing structure to engage an entrance to a user's ear canal, first acoustic impedance at the proximal end of the acoustic nozzle, and second acoustic impedance at the distal end of the acoustic nozzle. In this aspect, the acoustic nozzle has a nozzle volume between the first acoustic impedance and the second acoustic impedance, the first acoustic impedance, second acoustic impedance, and nozzle volume being selected to control resonance in the user's ear canal when the sealing structure is engaged with the entrance to the user's ear canal.

In some implementations, the first acoustic impedance is different than the second acoustic impedance.

In certain implementations, the first acoustic impedance, second acoustic impedance, and volume of the acoustic nozzle are selected to control resonance in a first frequency band centered at approximately 3 KHz and in a second frequency band centered at approximately 6 KHz.

In some implementations, the first acoustic impedance is a first acoustic mesh formed of an acoustic material.

In certain implementations, the first acoustic impedance has an acoustic impedance value of between $1\times10^7$ to $2.6\times10^8$ acoustic ohms.

In some implementations, the first acoustic impedance has an acoustic impedance of approximately $5.2\times10^7$ acoustic ohms.

In certain implementations, the first acoustic material has a 260 MKS rayl impedance with 5 $mm^2$ exposed area.

In some implementations, the first acoustic mesh is curved about a line extending in a direction perpendicular from a center axis of the acoustic nozzle to form a section of a cylinder.

In certain implementations, the section of the cylinder has a radius of curvature in a range between 2 and 100 mm.

In some implementations, the section of the cylinder has a radius of curvature of approximately 12 mm.

In certain implementations, the second acoustic impedance is a second acoustic mesh formed of an acoustic material.

In some implementations, the second acoustic impedance has an acoustic impedance value of between $1.0\times10^7$ to $4.0\times10^8$ acoustic ohms.

In certain implementations, the second acoustic impedance has an acoustic impedance of approximately $8.5\times10^7$ acoustic ohms.

In some implementations, the second acoustic material has an 850 MKS rayl impedance with 10 $mm^2$ exposed area.

In certain implementations, the second acoustic mesh is curved about a line extending in a direction perpendicular from a center axis of the acoustic nozzle to form a section of a cylinder.

In some implementations, the section of the cylinder has a radius of curvature in a range between 2 and 100 mm.

In certain implementations, the section of the cylinder has a radius of curvature of 12 mm.

In some implementations, the nozzle is formed in the shape of a cone and the nozzle volume between the first acoustic impedance and the second acoustic impedance is in a range between 15 $mm^3$ and 250 $mm^3$.

In certain implementations, the nozzle volume between the first acoustic impedance and the second acoustic impedance is approximately 47 $mm^3$ with a length of approximately 10 mm.

In some implementations, the acoustic nozzle is formed from a rigid material, and wherein a flexible portion of the sealing structure extends beyond the second acoustic impedance at the distal end of the acoustic nozzle.

In certain implementations, the body further includes a positioning and retaining structure designed to hold the earpiece relative to the user's ear.

In another aspect, an earpiece includes a body having an acoustic driver and an output aperture, a sealing structure extending from a region adjacent the output aperture to hold the output aperture adjacent to the entrance to the user's ear canal, and an acoustic nozzle extending from the acoustic driver toward the output aperture, the acoustic nozzle including an acoustic passage between an entrance aperture and the output aperture to conduct sound waves from the acoustic driver toward the output aperture, the acoustic passage having a proximal end adjacent the acoustic driver and a distal end toward the output aperture. A first acoustic impedance is provided at the proximal end of the acoustic nozzle, and a second acoustic impedance is provided at the distal end of the acoustic nozzle. In this aspect, the acoustic nozzle has a nozzle volume between the first acoustic impedance and the second acoustic impedance, the first acoustic impedance, second acoustic impedance, and nozzle volume being selected to control resonance in the user's ear canal when the sealing structure is engaged with the entrance to the user's ear canal. In this aspect, the first acoustic impedance has a different acoustic impedance value than the second acoustic impedance.

In another aspect, an acoustic nozzle for an earpiece includes an acoustic passage to conduct sound waves from an acoustic driver toward an output aperture, the acoustic passage having a proximal end configured to be adjacent the acoustic driver and a distal end configured to be adjacent the output aperture, first acoustic impedance means at the proximal end of the acoustic nozzle, and second acoustic impedance means at the distal end of the acoustic nozzle. In this aspect, the acoustic nozzle has a nozzle volume between the first acoustic impedance and the second acoustic impedance, the first acoustic impedance, second acoustic impedance, and nozzle volume being selected to control resonance in a first frequency band centered at approximately 3 KHz and in a second frequency band centered at approximately 6 KHz.

BRIEF DESCRIPTION OF THE DRAWINGS

FIG. 1 is an example cross-section of the human ear.

FIG. 2 is a plot of volume vs. frequency of an example earpiece with different acoustic nozzle configurations.

FIGS. 4A-4C are views of a portion of the earpiece of FIG. 3.

FIGS. 5A-5B are cross-sections of the earpiece portions of FIGS. 4A-4C.

DETAILED DESCRIPTION

Figure 3:
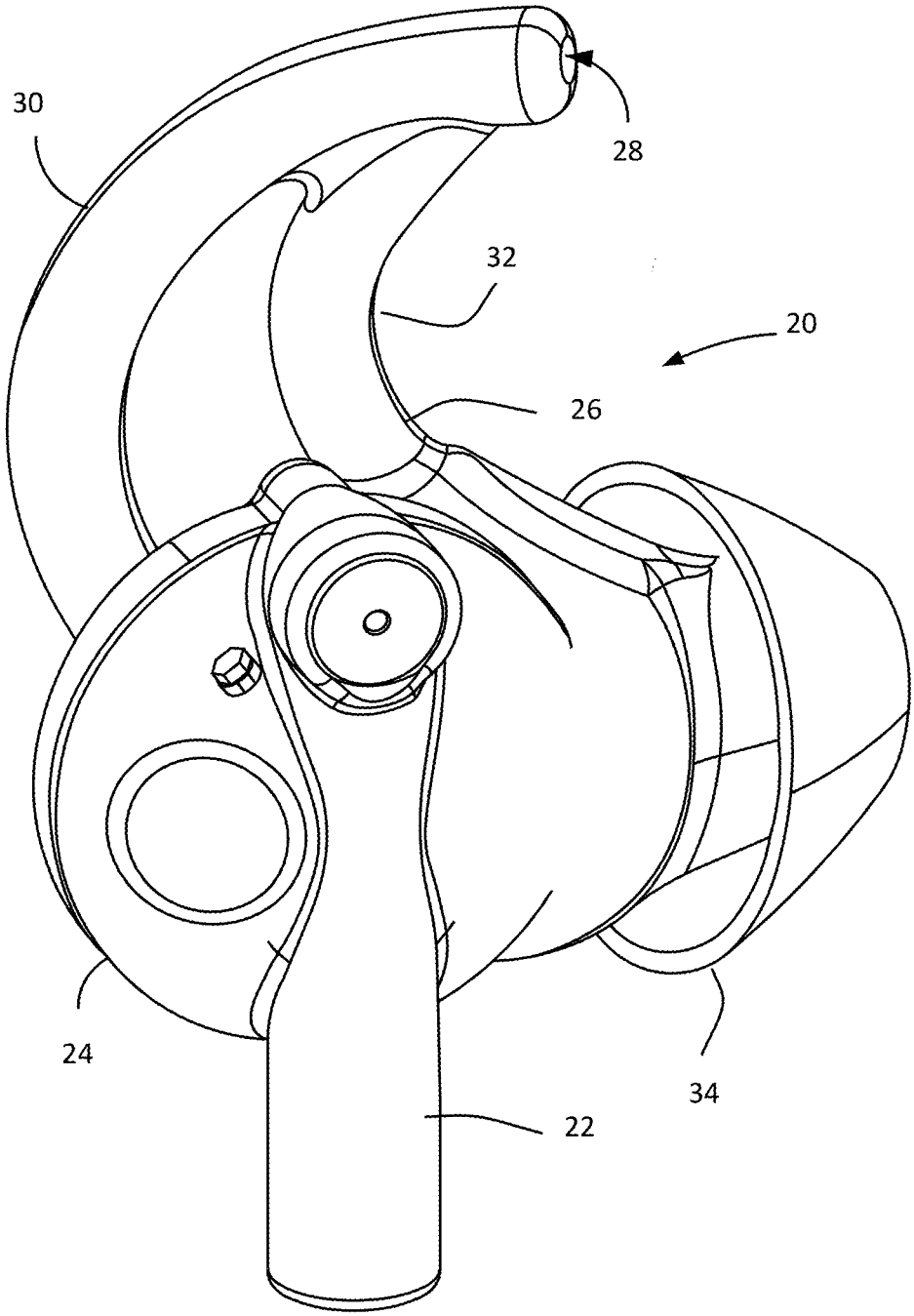
FIG. 3 is an isometric view of an example earpiece.
Figure 6:
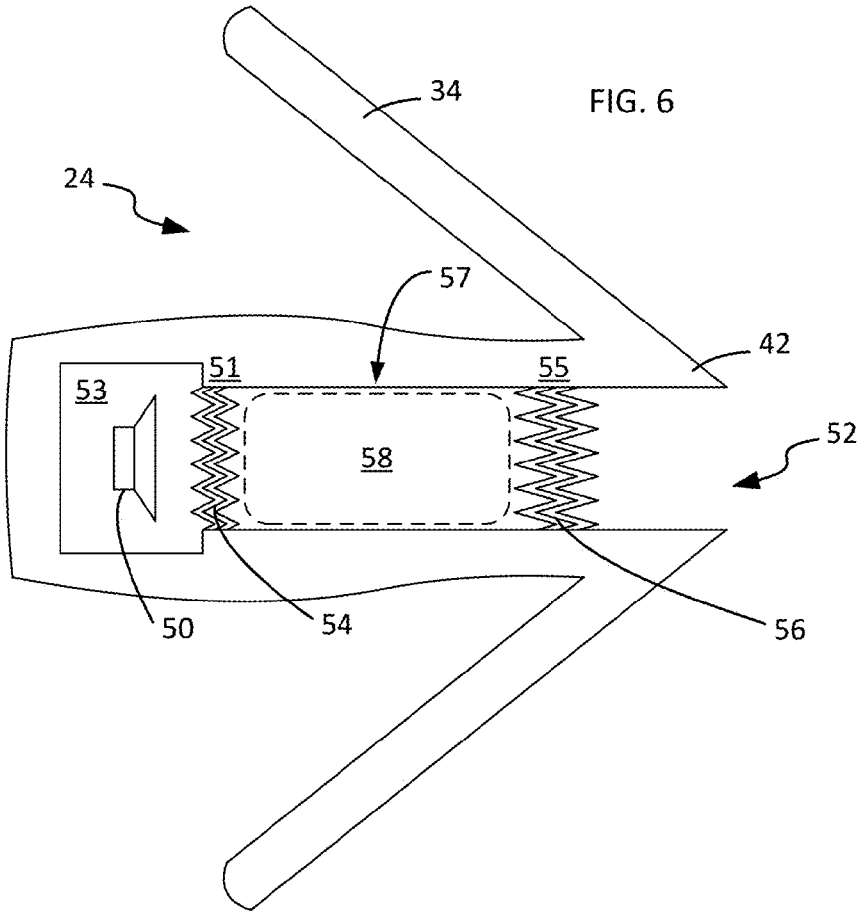
FIG. 6 is an example cross-section view of an earpiece having an acoustic nozzle.

This disclosure is based, at least in part, on the realization that it would be advantageous to provide an acoustic nozzle with controlled volume and impedance at both ends to tune resonance modes of an in-ear acoustic earpiece. For in-ear devices, a tight coupling between the in-ear device and the ear canal is required to provide sufficient low frequency performance. The tight coupling between the in-ear device and ear canal can cause resonance within the ear canal, however, which may be uncomfortable or unpleasant for the user. Since different users have different ear geometries, the particular resonance frequency will vary for different users, but typically occurs in a frequency band close to 6 kHz. Likewise, the acoustic driver of the in-ear device may have its own resonance frequency, which often occurs in a frequency band centered at around 3 kHz. By tuning the length and volume of the acoustic nozzle coupling the acoustic driver to the ear canal, and providing acoustic impedance at both ends of the acoustic nozzle, it is possible to partially control resonance in these frequency bands to properly shape the audio response perceived by a user of the earpiece.

FIG. 1 shows an example cross-section of the human ear, with some features identified. There are many different ear sizes and geometries and the example shown in FIG. 1 is merely one example. As shown in FIG. 1, the ear canal 10 is an irregularly shaped cylinder with a variable cross sectional area and a centerline 12 that is typically not straight. The entrance to the ear canal 14 refers to the portion of the ear canal near the concha where the walls of the ear canal are substantially non parallel to the centerline of the ear canal. As noted above, the precise structure of the human ear varies widely from individual to individual. For example, in the cross section of FIG. 1, there is a relatively gradual transition from ear canal walls that are non-parallel to a centerline 12 of the ear canal 10, to walls that are substantially parallel to a centerline 12 of the ear canal 10, so the entrance 14 to the ear canal in FIG. 1 is relatively long. In other example geometries, the entrance may exhibit a sharper transition from walls that are non-parallel to a centerline of the ear canal to walls that are substantially parallel to the centerline of the ear canal, so the entrance to the ear canal is relatively shorter than the entrance shown in FIG. 1.

The length and width of the ear canal both affect the resonance properties of the ear canal. Likewise, since the shape of the entrance to the ear canal can affect placement of an acoustic earpiece relative to the ear drum at the rear of the ear canal, the shape of the entrance 14 can also affect the resonance properties of the ear canal when an in-ear device is placed adjacent the ear canal.

FIG. 2 is a graph showing the acoustic sound pressure level (decibels) vs. frequency (Hz) of sound at an ear of a user of an example earpiece such as the example earpiece shown in FIG. 3. The graph shows the sound pressure level at the ear drum, when the earpiece is coupled to the entrance to the user's ear canal. In FIG. 2, line 16 shows the volume level of a conventional earpiece. As shown in FIG. 2, a conventional earpiece exhibits a first relatively strong resonance at around 3 KHz and a second relatively strong resonance at around 6 KHz. The 3 KHz resonance spike is associated with resonance of an acoustic driver of the earpiece, and the 6 KH resonance spike is associated with resonance of the user's ear canal.

Line 18 in FIG. 2 shows an example sound pressure level when impedance is distributed to each end of the acoustic nozzle and the volume of the acoustic nozzle is tuned to control resonance at selected frequency bands which, in this instance, are centered at around 3 KHz and 6 KHz. As shown in FIG. 2, the resonance at 3 KHz still occurs, and although a resonance spike at 6 KHz is still present, the magnitude of the spike (volume increase within the resonance band) is significantly less than the resonance spike of a conventional earpiece. For example, as shown in FIG. 2, the resonance spike at around 6 KHz is on the order of 7 decibels lower than the conventional resonance level and additionally has a lower Q value, which is a measure of the resonator's bandwidth relative to its center frequency. Hence, as discussed below, adding acoustic impedance at both ends of the acoustic nozzle and adjusting the volume of the acoustic nozzle can significantly reduce the non-uniformities of user perceived sound levels associated with resonance of the driver and resonance within the user's ear canal when implemented in an in-ear earpiece that is tightly coupled to a user's ear canal.

Specifically, as shown in the graph of FIG. 2, the nozzle geometry and impedances can be used to reduce output and damp the 6 kHz resonance while minimally impacting the 3 kHz resonance. In both instances the nozzles have the same total lumped element nozzle impedance. The difference is in the conventional case (line 16) all the purely resistive impedance is located at one end of the nozzle whereas, as shown by line 18, by distributing the resistive impedance to both ends of the nozzle significant reductions in the resonance spike at around 6 KHz may be obtained.

Additional details of a particular example earpiece will now be provided in connection with FIGS. 3-9. Other embodiments may use other physically shaped earpieces that are designed to be in-ear devices.

FIG. 3 shows an example earpiece 20. The earpiece 20 may include a stem 22 for positioning cabling and the like, an acoustic driver module 24, and a tip 26 (more clearly identified in FIGS. 4A-4C and 5A-5B). Tip 26 includes a sealing structure 34 to engage the entrance 14 to the user's ear canal 10. Some earpieces may lack the stem 22 but may include electronics modules (not shown) for wirelessly communicating with external devices. The tip 26 includes a positioning and retaining structure 28, which in this example includes an outer leg 30 and an inner leg 32. The positioning and retaining structure 28 is designed, in this example, to hold the earpiece relative to the user's ear.

The positioning and retaining structure 28 in the illustrated example is designed to engage one or more portions of an inner surface of the user's outer ear. In this example, the earpiece 20 is designed to be placed in the ear and twisted to enable the positioning and retaining structure to engage the user's ear. The earpiece is thus oriented and held in place by positioning and retaining structure 28 and other portions of the earpiece.

Other example earpieces may be designed to engage other aspects of the user's ear. For example, the earpiece may instead be formed to include a loop to extend around a top or back part of the user's ear. In another example the frictional fit between the sealing structure 34 and the entrance 14 to the ear canal 10 may be used to retain the earpiece 20 within the user's ear. Many different ways of forming the positioning and retaining structure may thus be utilized in connection with different example earpieces.

Sealing structure 34 is configured to couple the earpiece 20 to the ear canal of the user so that sound produced by an acoustic driver 50 (see FIG. 6) in the acoustic driver module 24 can be heard by the user. As noted above, when the earpiece is properly oriented, the sealing structure 34 is oriented to engage the entrance 14 to the ear canal 10 to enable sound produced by an acoustic driver in the acoustic driver module 24 to be conveyed into the ear canal so that the sound can be perceived by the person using the earpiece 20.

FIGS. 4A-4C show several views of an example earpiece tip 26 of the earpiece 20. The tip 26 is connected to the acoustic driver module 24 and stem 22 shown in FIG. 3. Not all elements of the earpiece tip 26 are identified in all of the views. As shown in FIGS. 4A-4C, the tip 26 includes a body 36 and the positioning and retaining structure 28. The body 36 connects to the acoustic driver module 24 (see FIG. 2) and carries the sealing structure 34. A passageway 38 is formed through tip 26 from a rear area which connects to the acoustic driver module. Passageway 38 extends through body 36 to an output aperture 52 at the smaller end 42 of the sealing structure 34. The passageway 38 is formed to conduct sound waves produced by the acoustic driver in the acoustic driver module 24 to the user's ear canal.

The sealing structure 34 comprises a frusto-conical structure. The frusto-conical structure may have an elliptical or oval cross section (as shown in FIG. 4A), with walls that taper substantially linearly (as shown in FIGS. 4B, 4C 5A, & 5B). In one implementation, the shape of the sealing structure and the material from which it is made cause the stiffness, when measured in the direction of the arrow 40 of FIG. 4C to be in the range of 0.2 to 2 gf/mm. Examples of appropriate materials for the sealing structure include silicones, TPUs (thermoplastic polyurethanes) and TPEs (thermoplastic elastomers).

The smaller end 42 of the sealing structure 34 is dimensioned so that it fits inside the entrance 14 to the ear canal 10 of most users by a small amount and so that the sealing structure 34 contacts the entrance to the ear canal but does not contact the inside of the ear canal. The larger end 44 of the sealing structure is dimensioned so that it is larger than the entrance to the ear canal of most users.

The positioning and retaining structure 28 and the sealing structure 34 may be a single piece, made of the same material, for example a very soft silicone rubber, with a hardness of 30 Shore A or less. The walls 46 of the sealing structure 34 may be of a uniform thickness which may be very thin, for example, less than one mm at the thickest part of the wall and may taper to the base 44 of the frusto-conical structure so that the walls deflect easily, thereby conforming easily to the contours of the ear and providing a good seal and good passive attenuation without exerting significant radial pressure on the entrance to the ear canal. Since the different parts of the earpiece serve different functions, it may be desirable for different portions of the earpiece to be made of different materials, or materials with different hardnesses or moduli. For example, the hardness (durometer) of the positioning and retaining structure 28 may be selected for comfort (for example 12 Shore A). The hardness of the sealing structure 34 may be slightly higher (for example 20 Shore A) for better fit and seal. The hardness of the part of the sealing structure that mechanically couples the sealing structure to the body 36 may be higher still (for example 70 Shore A). Providing an increased hardness in the region designed to couple the sealing structure 34 to the body 36 may enable a more secure coupling between the sealing structure 34 and body 36. In some instances, using an increased hardness in this region may also cause the passageway 38 through which sound waves travel to have a more consistent shape and dimensions.

FIGS. 4A-4C show external views of an example earpiece tip 26 and FIGS. 5A-5B show cross-sectional views of the earpiece tip 26, with dimensions from an example implementation. In the implementations of FIGS. 4A-4C and 5A-5B, the sealing structure 34 is elliptical, with a major axis of 7.69 mm and a minor axis of 5.83 mm at the smaller end 42, and a major axis of 16.1 mm and a minor axis of 14.2 mm at the larger end 44. A sealing structure with dimensions such as these fits into the ear canal entrance of many users so that the smaller end protrudes into the ear canal by a small amount and does not contact the walls of the ear canal, so that the larger end does not fit in the ear canal, and so that the sealing structure 34 engages the entrance to the ear canal. Smaller or larger versions may be used for users with below- or above-averaged-sized ears, including children. Versions with similar overall size but different aspect ratios between major and minor axes may be provided for users with ear canal entrances that are more- or less-circular than average.

Figure 7A:
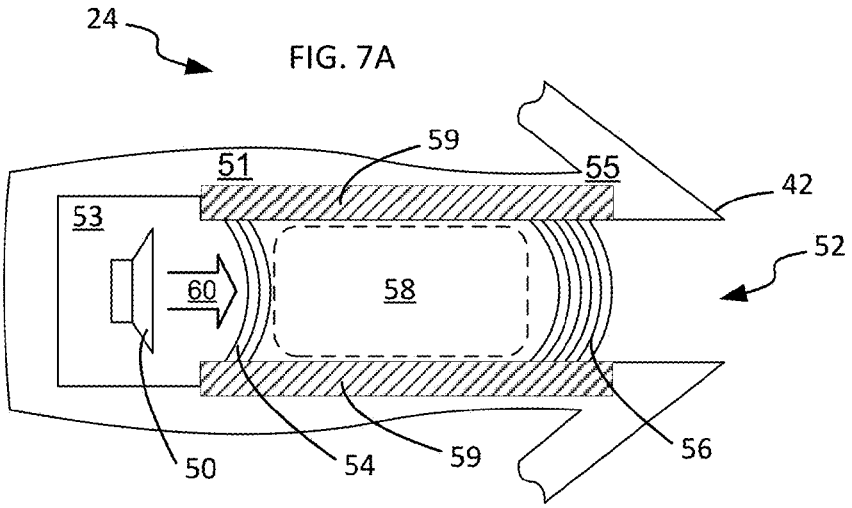
FIGS. 7A-7D are cross-section views of example acoustic nozzles of the earpiece of FIG. 6.
Figure 7B:
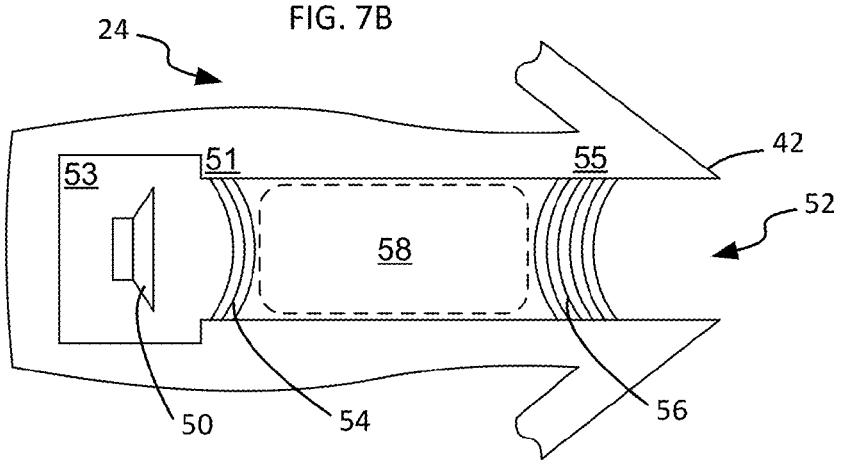
Figure 7C:
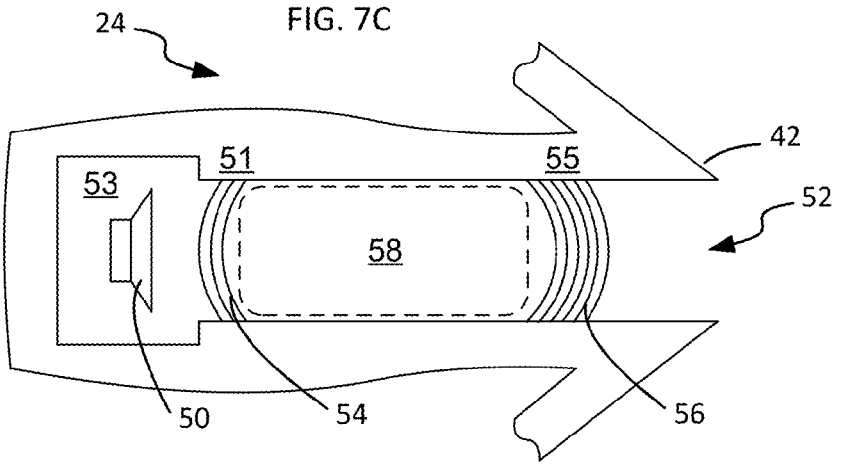
Figure 7D:
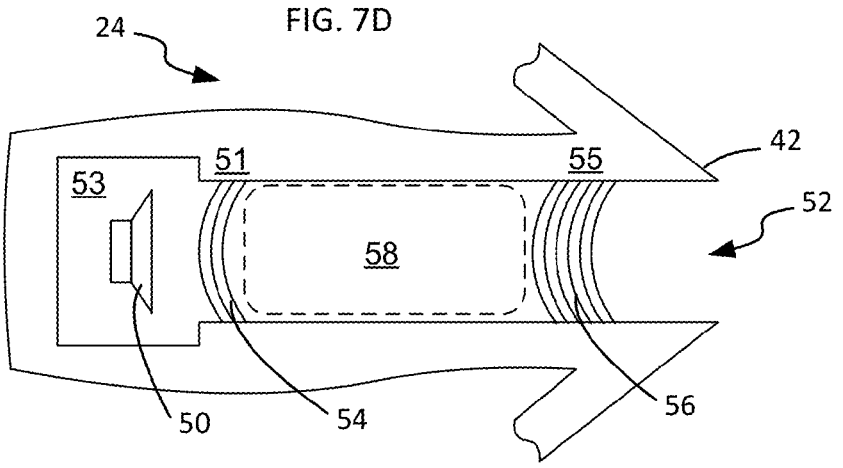

FIGS. 6 and 7A-7D show several example configurations of an acoustic earpiece having an acoustic driver 50 in acoustic communication with an acoustic nozzle 57 designed to tune resonance within the user's ear canal. Acoustic nozzle 57 interconnects between an entrance aperture 51 proximate an acoustic driver chamber 53, housing an acoustic driver 50 of acoustic driver module 24, and an output aperture 55 formed distally from the entrance aperture 51 relative to the acoustic driver chamber. In the examples shown in FIGS. 6 and 7A-7D, a first acoustic mesh 54 is provided at the entrance aperture 51 of the acoustic nozzle proximate the acoustic driver 50, and a second acoustic mesh 56 is provided at the output aperture of the acoustic nozzle 57 distal from acoustic driver 50. A cavity 63 (see FIG. 8) may exist between a front surface of the driver 50 and the first acoustic mesh 54. In an implementation the first and second acoustic meshes are located at the beginning and end of the nozzle and a flexible portion 42 of the ear tip 34 extends beyond the output aperture 55 of the nozzle 57. FIG. 7A shows an implementation in which the nozzle is formed as a more rigid structure, which is connected to and surrounded by a softer material forming the softer sealing structure 34. FIG. 9, discussed below, shows a similar arrangement.

Figure 8:
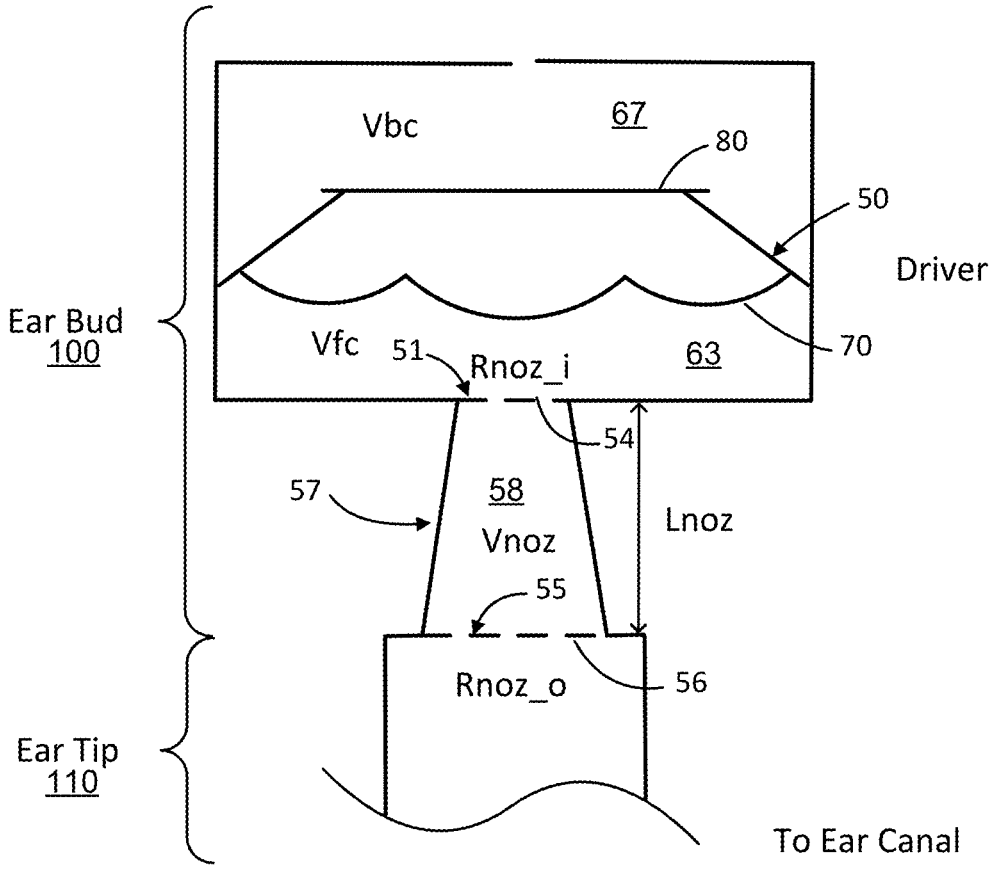
FIG. 8 is an example cross-sectional view of an earpiece showing an acoustic architecture of the earpiece.
Figure 9:
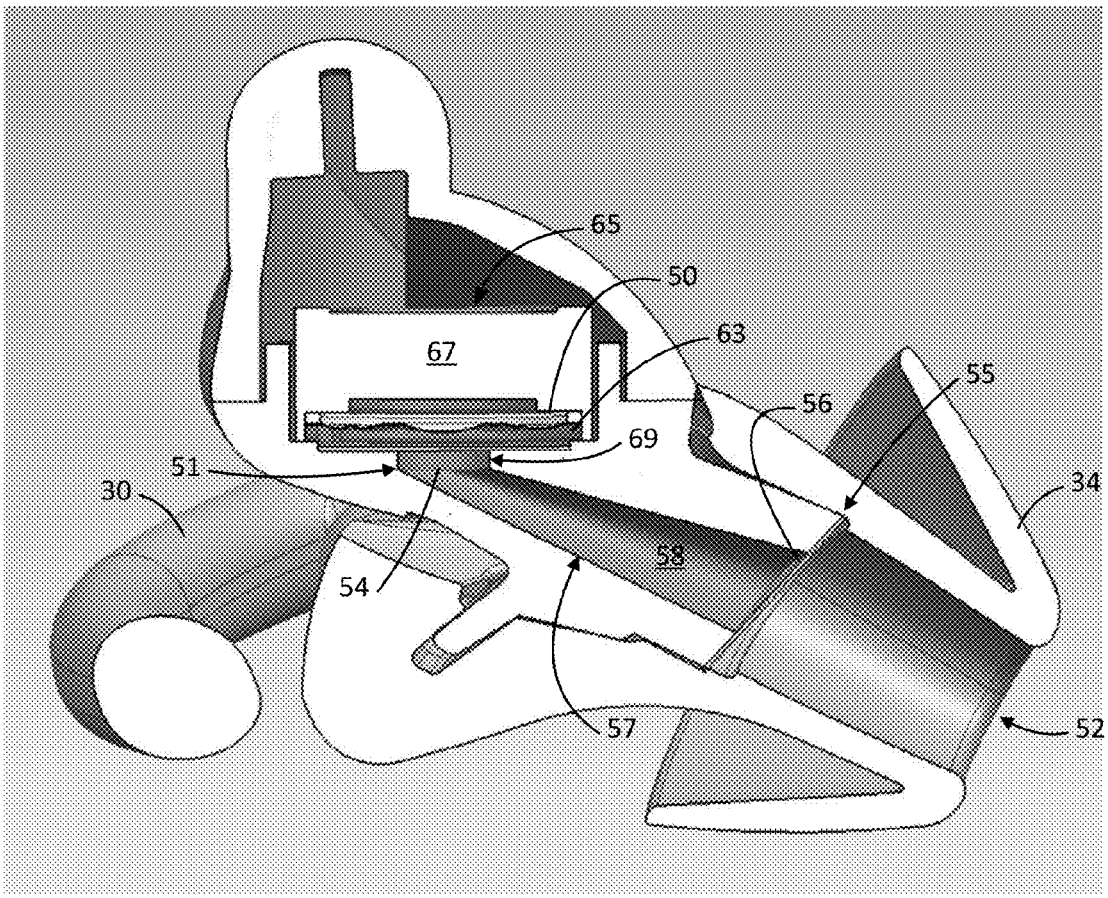
FIG. 9 is a perspective view in partial cross section of an example earpiece.

FIG. 8 shows an example acoustic architecture of an earpiece. In the example shown in FIG. 8, the earpiece includes an ear bud 100 and an ear tip 110. The ear tip 110 may be implemented, for example, as sealing structure 34. Ear bud 100 includes electronic components and a driver 50 for producing sound. Ear bud 100 further includes a nozzle 57 connecting the driver to the ear tip.

Driver 50 is enclosed in a driver cavity including a front cavity 63 having a first volume Vfc and a back cavity 67 having a second volume Vbc. In some implementations, an opening in the front cavity is formed to connect the driver cavity to nozzle 57. In some implementations the opening in the front cavity may be roughly centered over a diaphragm 70 of the driver 50 to connect the front cavity volume to the nozzle. The nozzle may be a conical volume and extend from the entrance aperture 51 to the exit aperture 55.

The acoustic impedance of the first acoustic mesh 54, the acoustic impedance of the second acoustic mesh 56, and a volume 58 of the acoustic nozzle 57, are tuned to control resonance to shape the response of the earpiece at approximately 3 KHz and 6 KHz, as shown in FIG. 2. For example, as shown in FIG. 2, the shape of the 3 KHz resonance spike may be narrowed by inclusion of mesh at both the entrance and output apertures of the nozzle. Likewise, in the 6 KHz frequency band, the magnitude of the resonance spike may be significantly lowered by inclusion of mesh at both the entrance and output apertures of the nozzle.

In one implementation, as shown in FIG. 9, an entrance cavity 69 to the acoustic nozzle 57 may be provided proximal to acoustic driver 50. For example, the entrance cavity 69 may be formed as a 25 $mm^3$ volume in front of driver cavity 63 that transitions to a 5 $mm^2$ entrance aperture 51 of the nozzle 57. In the implementation shown in FIG. 9, the output aperture 55 of nozzle 57 is significantly larger than the 5 $mm^2$ entrance aperture 51. For example, the output aperture 55 may be approximately 10 $mm^2$.

The acoustic mesh 54 proximal the acoustic driver and the acoustic mesh 56 distal from the acoustic driver may be formed of the same material or may be formed from different materials. In one implementation, the acoustic mesh 54 proximal the acoustic driver is selected to preferentially attenuate sound in a band encompassing 3 KHz to reduce perceived resonance in this frequency band. An example acoustic material that may be used, in one implementation, has a 260 MKS rayl impedance with 5 $mm^2$ exposed area resulting in an acoustic impedance of approximately $$5.2\times10^7\frac{\text{kg}}{s*m^4}$$

(Acoustic Ohms). In other implementations the acoustic mesh 54 may be formed using acoustic materials having an acoustic impedance in a range from $1\times10^7$ to $$2.6\times10^8\frac{\text{kg}}{sm^4}.$$

In one implementation, the acoustic mesh 56 distal from the acoustic driver is selected to preferentially attenuate sound in a band encompassing 6 KHz to control resonance to provide a desired acoustic response of the earpiece. An example acoustic material that may be used, in one implementation, has an 850 MKS rayl impedance with 10 $mm^2$ exposed area resulting in an acoustic impedance of approximately $$8.5\times10^7\frac{\text{kg}}{s*m^4}.$$

In other implementations the acoustic mesh 56 may be formed using acoustic materials having an acoustic impedance in a range from $1\times10^7$ to $$4\times10^8\frac{\text{kg}}{sm^4}.$$

In one implementation, a nozzle volume 58 between first acoustic mesh 54 and second acoustic mesh 56 is approximately 47 $mm^3$ with a length of approximately 10 mm. In other implementations the volume can vary from 15 $mm^3$ to 250 $mm^3$, and the length can range from 4 mm to 20 mm. In some implementations the nozzle volume is a conical volume in which a diameter of the entrance aperture 51 is smaller than a diameter of the output aperture 55.

The acoustic mesh 54, 56 may be planar or, optionally, may be a planar mesh that has been curved about a line extending in a direction perpendicular from a center axis of the acoustic nozzle to form a section of a cylinder. Where the output aperture 52 of the sealing structure 34 is elliptical, the line about which the acoustic mesh is curved may correspond with the major axis of the ellipse, may correspond with the minor axis of the ellipse, or may not correspond with either axis. When the acoustic mesh is curved to form a section of a cylinder, a radius of curvature of the mesh may be, in one implementation, 12 mm. In other implementations the radius of curvature of the mesh may be implemented using a radius of curvature in a range from 2 mm to 100 mm.

FIGS. 7A-7D shows example profiles of the acoustic mesh 54, 56. In the example shown in FIG. 7A, acoustic mesh 54 is formed from a planar surface that is curved to form a section of a cylinder such that the surface is concave when viewed from the acoustic driver 50. Curvature in this direction will be referred to herein as being "concave in the direction of the acoustic driver". An acoustic mesh which is formed from a planar surface that is curved in one direction such that the surface is convex when viewed from the acoustic driver 50, such as the acoustic mesh shown in FIG. 7D, will be referred to herein as being "convex in the direction of the acoustic driver". Forming the acoustic mesh to be curved, as shown in FIGS. 7A-7D helps prevent the acoustic mesh from mechanically resonating by providing additional stiffness to the acoustic mesh.

Many ways of forming the acoustic mesh may be implemented. In the example shown in FIG. 7A, acoustic mesh 54 is concave in the direction of the acoustic driver and acoustic mesh 56 is also concave in the direction of the acoustic driver. In the example shown in FIG. 7B, acoustic mesh 54 is concave in the direction of the acoustic driver and acoustic mesh 56 is convex in the direction of the acoustic driver. In the example shown in FIG. 7C, acoustic mesh 54 is convex in the direction of the acoustic driver and acoustic mesh 56 is concave in the direction of the acoustic driver. In the example shown in FIG. 7D, acoustic mesh 54 is convex in the direction of the acoustic driver and acoustic mesh 56 is also convex in the direction of the acoustic driver.

A number of implementations have been described. Nevertheless, it will be understood that additional modifications may be made without departing from the scope of the inventive concepts described herein, and, accordingly, other implementations are within the scope of the following claims.

What is claimed is:

1. An earpiece, comprising:

an acoustic driver;

an acoustic nozzle extending from the acoustic driver toward an output aperture, the acoustic nozzle including an acoustic passage between an entrance aperture and the output aperture to conduct sound waves from the acoustic driver toward the output aperture, the acoustic passage having a proximal end adjacent the acoustic driver and a distal end toward the output aperture;

a sealing structure to engage an entrance to a user's ear canal;

first acoustic impedance at the proximal end of the acoustic nozzle; and second acoustic impedance at the distal end of the acoustic nozzle;

wherein the first acoustic impedance is a first acoustic mesh formed of an acoustic material, and wherein the acoustic nozzle has a nozzle volume between the first acoustic impedance and the second acoustic impedance, the first acoustic impedance, second acoustic impedance, and nozzle volume being selected to control resonance in the user's ear canal when the sealing structure is engaged with the entrance to the user's ear canal.

2. The earpiece of claim 1, wherein the first acoustic impedance has a different acoustic impedance value than the second acoustic impedance.

3. The earpiece of claim 1, wherein the first acoustic impedance, second acoustic impedance, and volume of the acoustic nozzle are selected to control resonance in a first frequency band centered at approximately 3 KHz and in a second frequency band centered at approximately 6 KHz.

4. The earpiece of claim 1, wherein the first acoustic impedance has an acoustic impedance value of between $1\times10^7$ to $2.6\times10^8$ acoustic ohms.

5. The earpiece of claim 4, wherein the first acoustic impedance has an acoustic impedance value of approximately $5.2\times10^7$ acoustic ohms.

6. The earpiece of claim 1, wherein the first acoustic material has a 260 MKS rayl impedance with 5 $mm^2$ exposed area.

7. The earpiece of claim 1, wherein the first acoustic mesh is curved about a line extending in a direction perpendicular from a center axis of the acoustic nozzle to form a section of a cylinder.

8. The earpiece of claim 7, wherein the section of the cylinder has a radius of curvature in a range between 2 mm and 100 mm.

9. The earpiece of claim 7, wherein the section of the cylinder has a radius of curvature of approximately 12 mm.

10. The earpiece of claim 1, wherein the second acoustic impedance is a second acoustic mesh formed of an acoustic material.

11. The earpiece of claim 10, wherein the second acoustic impedance has an acoustic impedance value of between $1.0\times10^7$ to $4.0\times10^8$ acoustic ohms.

12. The earpiece of claim 11, wherein the second acoustic impedance has an acoustic impedance of approximately $8.5\times10^7$ acoustic ohms.

13. The earpiece of claim 10, wherein the second acoustic material has an 850 MKS rayl impedance with 10 $mm^2$ exposed area.

14. The earpiece of claim 10, wherein the second acoustic mesh is curved about a line extending in a direction perpendicular from a center axis of the acoustic nozzle to form a section of a cylinder.

15. The earpiece of claim 14, wherein the section of the cylinder has a radius of curvature in a range between 2 mm and 100 mm.

16. The earpiece of claim 15, wherein the section of the cylinder has a radius of curvature of 12 mm.

17. The earpiece of claim 1, wherein the nozzle is formed in the shape of a cone and the nozzle volume between the first acoustic impedance and the second acoustic impedance is in a range between 15 $mm^3$ and 250 $mm^3$.

18. The earpiece of claim 17, wherein the nozzle volume between the first acoustic impedance and the second acoustic impedance is approximately 47 $mm^3$ with a length of approximately 10 mm.

19. The earpiece of claim 1, wherein the acoustic nozzle is formed from a rigid material, and wherein a flexible portion of the sealing structure extends beyond the second acoustic impedance at the distal end of the acoustic nozzle.

20. The earpiece of claim 1, wherein the earpiece further includes a positioning and retaining structure designed to hold the earpiece relative to the user's ear.

21. An earpiece, comprising:

a body having an acoustic driver and an output aperture;

a sealing structure extending from a region adjacent the output aperture to hold the output aperture adjacent to the entrance to the user's ear canal;

an acoustic nozzle extending from the acoustic driver toward the output aperture, the acoustic nozzle including an acoustic passage between an entrance aperture and the output aperture to conduct sound waves from the acoustic driver toward the output aperture, the acoustic passage having a proximal end adjacent the acoustic driver and a distal end toward the output aperture;

first acoustic impedance at the proximal end of the acoustic nozzle; and second acoustic impedance at the distal end of the acoustic nozzle;

wherein the first acoustic impedance is an acoustic mesh formed of an acoustic material, and wherein the acoustic nozzle has a nozzle volume between the first acoustic impedance and the second acoustic impedance, the first acoustic impedance, second acoustic impedance, and nozzle volume being selected to control resonance in the user's ear canal when the sealing structure is engaged with the entrance to the user's ear canal;

and wherein the first acoustic impedance has a different acoustic impedance value than the second acoustic impedance.

22. An acoustic nozzle for an earpiece, comprising:

an acoustic passage to conduct sound waves from an acoustic driver toward an output aperture, the acoustic passage having a proximal end configured to be adjacent the acoustic driver and a distal end configured to be adjacent the output aperture;

first acoustic impedance means at the proximal end of the acoustic nozzle; and second acoustic impedance means at the distal end of the acoustic nozzle;

wherein the first acoustic impedance is an acoustic mesh formed of an acoustic material, and wherein the acoustic nozzle has a nozzle volume between the first acoustic impedance and the second acoustic impedance, the first acoustic impedance, second acoustic impedance, and nozzle volume being selected to control resonance in a first frequency band centered at approximately 3 KHz and in a second frequency band centered at approximately 6 KHz.

* * * * *